US005769405A

United States Patent [19]

Glanzmann et al.

[11] Patent Number: 5,769,405

[45] Date of Patent: Jun. 23, 1998

[54] DEVICE FOR FEEDING A GATHERING SECTION OF A GATHER-STITCHER

[75] Inventors: Alfred Glanzmann, Reiden; Heinz Boss, Strengelbach, both of Switzerland

[73] Assignee: GRAPHA-Holding AG, Hergiswil, Switzerland

[21] Appl. No.: 574,681

[22] Filed: Dec. 19, 1995

[30] Foreign Application Priority Data

Dec. 22, 1994 [CH] Switzerland ..... 03882/94

[51] Int. Cl.[6] ..... B65H 39/00

[52] U.S. Cl. ..... 270/52.16; 270/52.24; 270/52.25

[58] Field of Search ..... 270/52.23, 52.24, 270/52.25, 52.16

[56] References Cited

U.S. PATENT DOCUMENTS

| | | | |
|---|---|---|---|
| 2,413,358 | 4/1946 | Kleineberg . | |
| 2,626,074 | 1/1953 | Vogt | 270/52.23 X |
| 4,127,261 | 11/1978 | Meratti | 270/52.23 |
| 4,200,275 | 4/1980 | Wangermann | 270/52.23 |
| 4,491,311 | 1/1985 | Glanzmann | 270/54 |
| 5,474,286 | 12/1995 | Reist | 270/52.25 |

FOREIGN PATENT DOCUMENTS

| | | |
|---|---|---|
| 2334071 | 1/1974 | Germany . |
| 586611 | 4/1977 | Switzerland . |
| 617905 | 6/1980 | Switzerland . |
| 625158 | 9/1981 | Switzerland . |
| 652103 | 10/1985 | Switzerland . |

*Primary Examiner*—Hoang Nguyen
*Attorney, Agent, or Firm*—Spencer & Frank

[57] ABSTRACT

A device for feeding a gathering section of a gather-stitcher includes a rotatingly driven conveyor drum which pulls printed sheets off a stack of a printed sheet magazine with the fold in front. The printed sheets are conveyed around the circumference of the conveyor drum in an approximately circular path to an arresting device and then into a trajectory extending in an opposite direction from the arresting device which trajectory terminates in a functional area of a rotating gripper device of an opening device which opens the printed sheets. A sweeping device comprising a deflection element is arranged for moving into the trajectory of the printed sheets. A guide element is located opposite the sweeping device during its movement, the sweeping device sweeping the respective printed sheets on the oppositely located guide element and into a gripping position associated with the gripper device.

11 Claims, 6 Drawing Sheets

1
2
3
8
9
10
11
11
15
15
19
20
21
22
23
24
29

DEVICE FOR FEEDING A GATHERING SECTION OF A GATHER-STITCHER

CROSS-REFERENCE TO RELATED APPLICATIONS

The present application claims the right of foreign priority with respect to Patent No. 03 882/94-0 filed in Switzerland on Dec. 22, 1994, the subject matter of which is incorporated herein by reference.

BACKGROUND OF THE INVENTION

The invention relates to a device for feeding a gathering section of a gather-stitcher comprising a rotatingly driven conveyor drum which pulls folded printed sheets (i.e., signatures) off a stack of a printed sheet magazine with the fold in front and having a circumference to which means are assigned for conveying the signatures in an approximately circular path in which there is disposed an arresting device and then into a trajectory extending in an opposite direction from the arresting device which trajectory terminates in a functional area of a rotating gripper device of an opening mechanism which opens the printed sheets.

Such devices are known from, among others, Swiss Patent Publication Nos. CH-A-586 611, 617 905 and 652 103.

A device of the type mentioned at the outset, which is sold by Müller Martini, is known by the name "Anleger 279" and has a printed sheet magazine receiving an upright stack and wherein the arresting device, in preparation for opening the printed sheets conveyed by the conveyor drum, is disposed on the approximately circular path approximately across from the removal point of the printed sheets from the stack. Along a further, oppositely directed path, a flap or rod is disposed in the trajectory of the printed sheets during processing of a post-fold or a pre-fold so that the opening process is initiated by the gripper device prior to gripping. A suction device, for example, is associated with the conveyor drum as the conveying means for the printed sheets on the circumference of the conveyor drum, which individually grips the stacked printed sheets in the edge area of the fold, so that a gripper provided on the conveyor drum can take them over.

SUMMARY OF THE INVENTION

An object of the invention is an improvement of the structure of the aforementioned feeding device because of the continuously demanded increase in the output of a feeding attachment, to which the amount of dependability also adds considerably.

The above and other objects are accomplished in the context of the device for feeding a gather-stitcher of the type first described above wherein according to the invention there is additionally provided a sweeping device comprising a deflection element arranged for moving into the trajectory of the signatures; and a guide element located opposite the sweeping device during its movement, the sweeping device sweeping the respective signatures on the oppositely located guide element and into a gripping position associated with the gripper device.

Due to the invention, it is possible to counteract with considerable success the non-guided conveyance of the signatures between the arresting device and the gripper device, especially since the signatures are conveyed with the open side which tends to flutter at the front when leaving the conveyor drum.

The device in accordance with the invention is preferably embodied with a deflection element, which can be displaced from an initial position behind the circumferential path of the conveyor drum and has a deflecting bar at its end which is pivotable parallel with the axis of rotation of the drum. The deflecting bar and the adjustable guide bar together form a guide gap or slot receiving the signatures, so that the unstable state existing because of the properties of the signatures can be eliminated to a large extent.

It is advantageous if in the gripping position of the gripper device the deflecting and guide bars are located opposite each other and form the narrowest guide gap, by means of which optimal transfer conditions in the trajectory of the signatures to the gripper device are created.

The rotating drum of the gripper device is designed with sector cutouts forming laterally spaced discs comprised of circular sections that present a radial support. In connection with processing wherein the signatures form a post-fold, i.e. the overhang, is located on the part of the signature resting against the radial support of the rotating drum of the gripper device, the gripper device includes a gripper element consisting of a pair of sheet grippers disposed in the cutout which cooperate with the radial support for gripping the sheets, and the guide bar is provided with a cutout at the end facing the gripper device for passage of the sheet gripper of the gripper pair holding the printed sheet in the gripper device.

If, on the other hand, the printed sheets form a pre-fold (i.e., the short leg of the signature rests against the radial support of the rotating drum of the gripper device), there is advantageously a requirement for a drum shaped gripper device with a sector-shaped cutout together with a driven gripper element disposed in the cutout, which lifts the portion of the signature provided with the overfold, subsequently holds the portion of the signature resting against the radial support, and assures a trouble-free transfer of the signature.

The gripper element is pivotally controlled for this purpose and is designed to cooperate with the radial support of the of the gripper device.

In the subsequent processing of the post-fold as well as the pre-fold signature, a smoothing roller is disposed downstream of the sweeping device, which smooths the signatures against the circumference of the rotating drum of the gripper device and aids in the exact and regular positioning of the signatures.

The smoothing roller is advantageously designed so it can be lifted off the gripper device against the force of a spring, by means of which an automatic adaptation to the thickness of the signatures can take place.

It has been shown to be advantageous if upstream of the sweeping device, with respect to the trajectory of the signatures from the arresting device, a rotatable support roller is disposed opposite the conveyor drum and limits the trajectory of the signature toward the outside, downstream of the arresting device.

In the process it can be advantageous if the rotatable support roller and the guide bar have a common axis of rotation or pivoting, which causes gentle handling of the signatures.

In the course of selective processing of the signatures after the post-folding or pre-folding, it has been shown to be particularly advantageous to provide a changeable control device which is assigned to the interchangeable grippers or gripper elements of the gripper device for post-fold and pre-fold processing, respectively.

According to a further aspect of the invention, a simple embodiment of the control device includes two control cams disposed stationarily next to each other on the axis of rotation of the gripper device, wherein one axially displaceable feeler roll, which is seated at a driven control lever rotating around the axis of rotation of the gripper device, is selectively changeable for post-folding and pre-folding, respectively.

Processing of the printed sheets on the way from the printed sheet magazine to the gathering section, of course, takes place in a clocked manner, i.e. each printed sheet removed from the printed sheet magazine is handed over to the gathering section at regular intervals.

The device in accordance with the invention will be discussed below, making reference to the drawings, to which further reference is made regarding all particulars not described in detail in the specification.

DETAILED DESCRIPTION OF THE PREFERRED EMBODIMENTS

Figure 1:
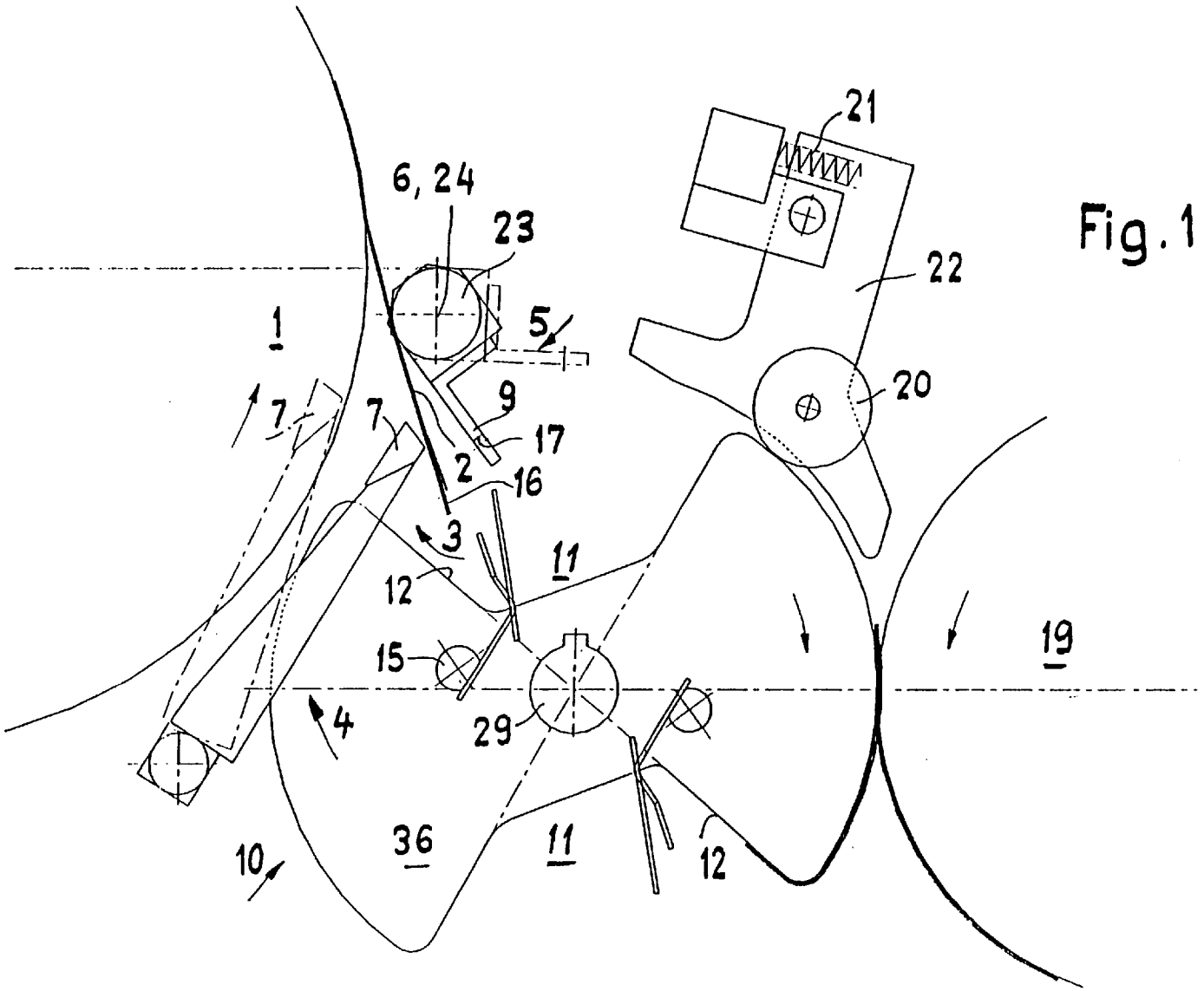
FIG. 1 is a schematic lateral view of the device in accordance with the invention in connection with post-fold processing.
Figure 2:
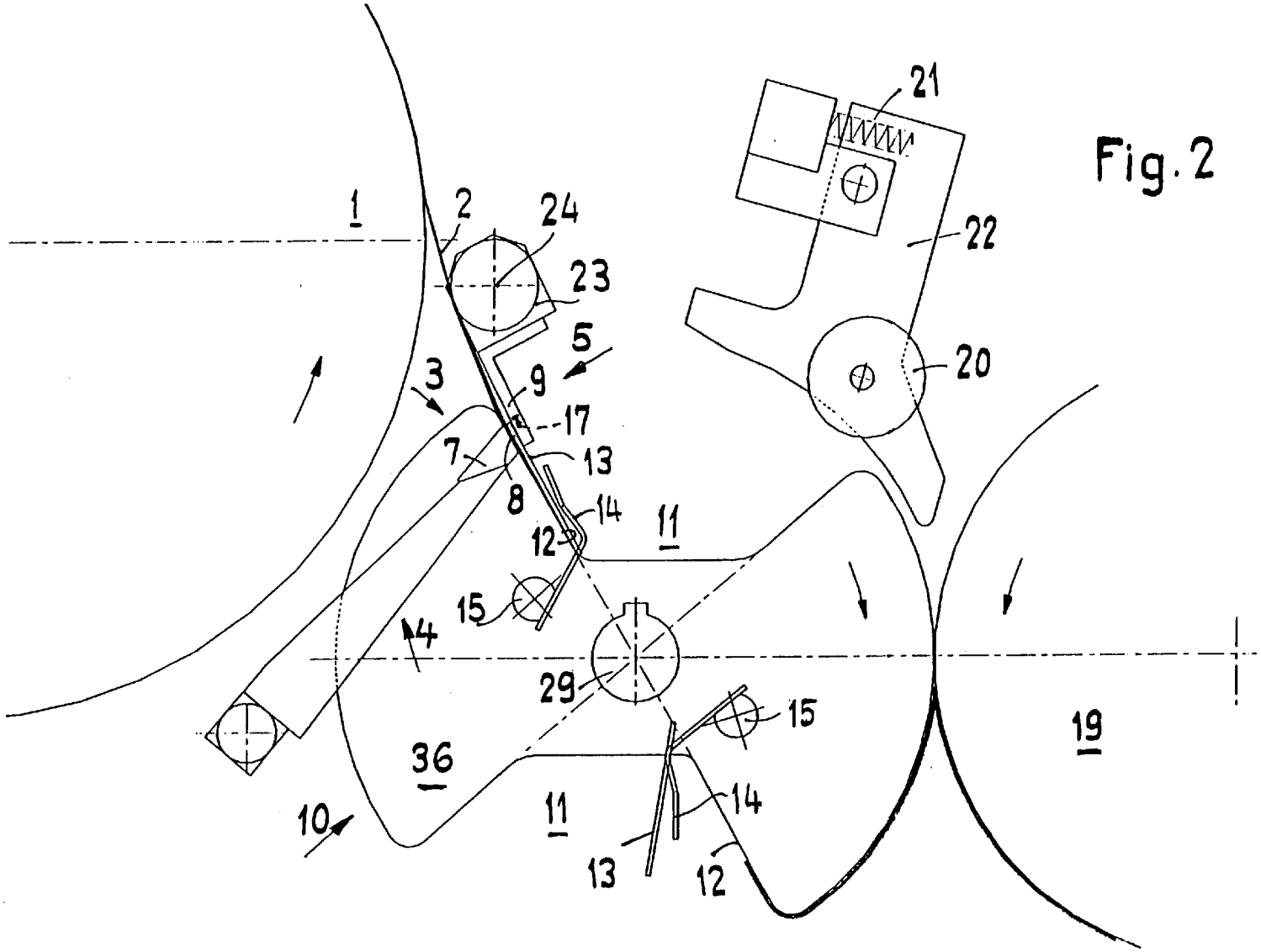
FIG. 2 is a lateral view of the device in a processing phase which is advanced in respect to FIG. 1.

FIG. 1 partially shows the circumference of a counter-clockwise rotating conveyor drum 1 of a signature feeder for a gather-stitcher (not shown) at a time when the fold of a signature 2 is located at an arresting device (not shown), and the open side of the signature is lifted off conveyor drum 1 by means of a sweeping device 3. Sweeping device 3 consists of a deflection element 4 which in the course of its movement from an initial position indicated by the dash-dot line inside the circumferential path of the conveyor drum 1 supports signature 2 in its trajectory and holds it against a guide element 5. Guide element 5 is pivotable around a shaft 6 and in an operative position forms a guide gap 8 (see FIG. 2) together with a deflecting bar 7 disposed at the free end of deflection element 4. In the course of the mutual application of deflecting bar 7 and guide element 5, which has a guide bar 9, a gripper device 10, which in the present case has two sector-shaped cutouts 11 on a drum-shaped rotating body, moves with trailing radial support 12 into a position which is aligned with guide gap 8, where subsequently signature 2 is gripped by a gripper pair formed by the sheet gripper 13 and overfold gripper 14. Sheet gripper 13 and overfold gripper 14 are driven via control cams, of which one control cam 15 is represented. Sheet gripper 13 is disposed next to overfold gripper 14 and acts on the entire signature 2, while overfold gripper 14, which is preferably placed downstream of sheet gripper 13, exclusively maintains overfold 16 of signature 2 against support 12, i.e. in the course of post-fold processing of signatures 2. So that sheet gripper 13, which rotates together with gripper device 10, can pass through guide bar 9 applied to deflection element 4, guide bar 9 is provided at its free end with a cutout 17.

Figure 3:
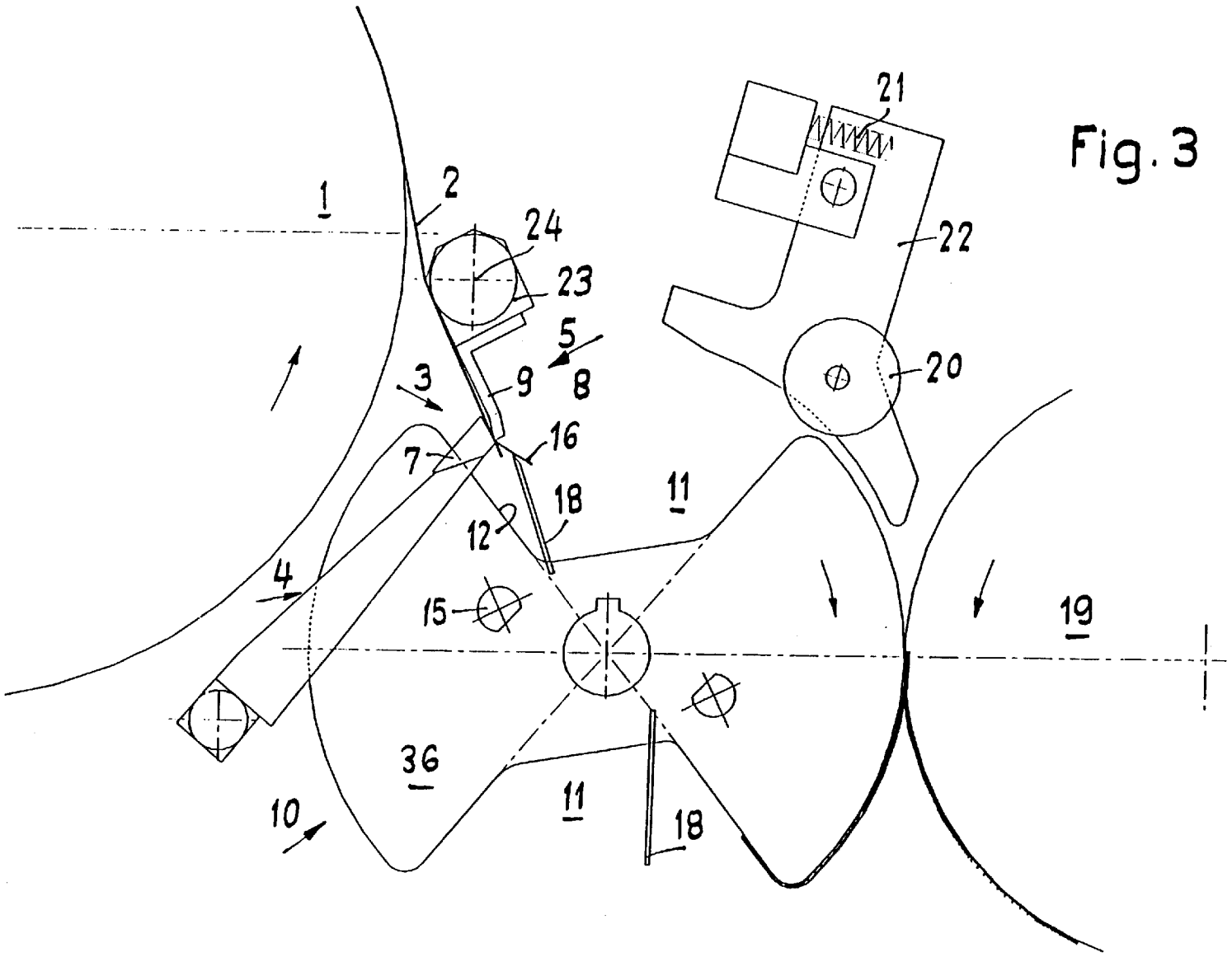
FIG. 3 is a lateral view of the device in accordance with the invention in connection with pre-fold processing.
Figure 4:
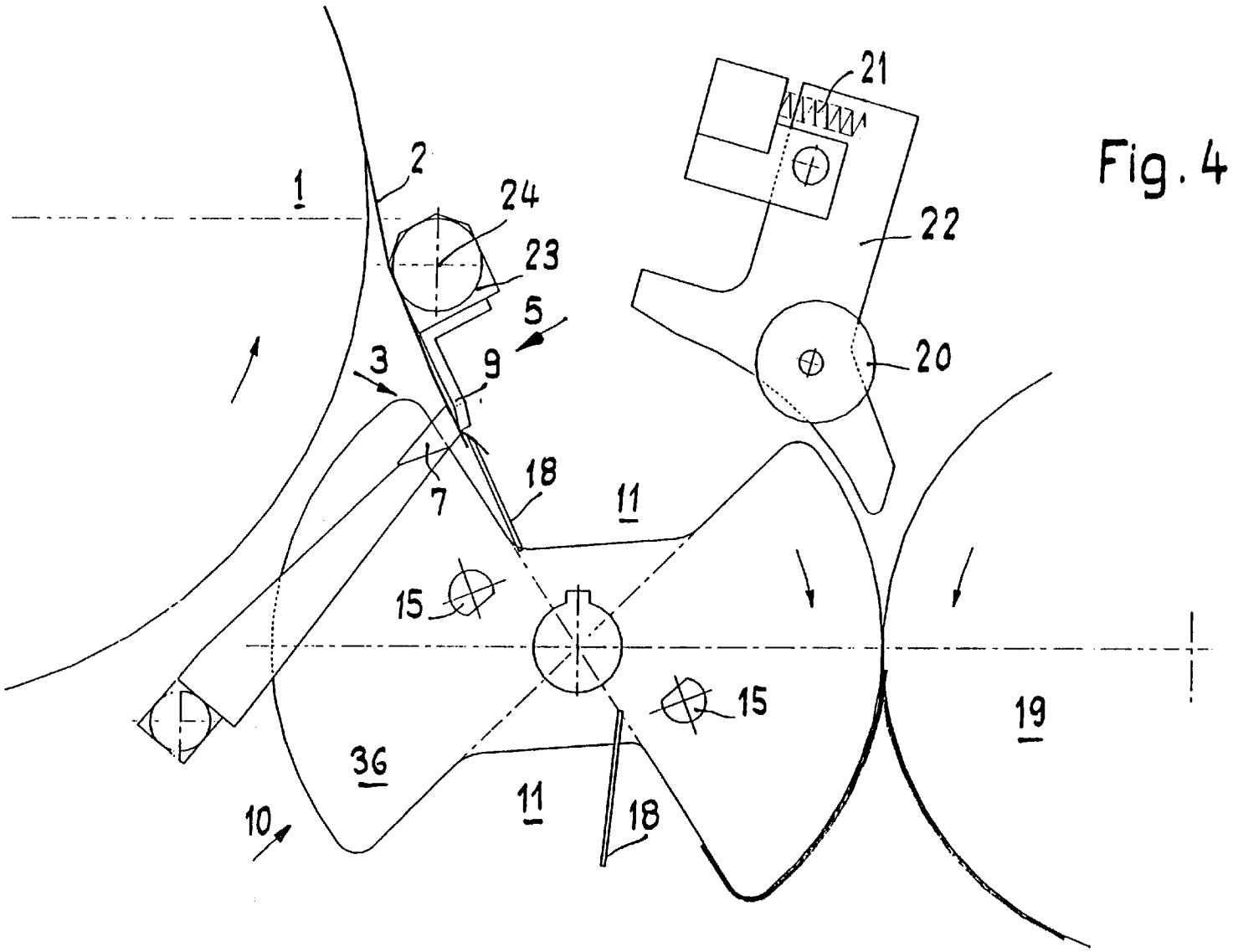
FIG. 4 is a lateral view of the device in a processing phase which is advanced in respect to FIG. 3.
Figure 5:
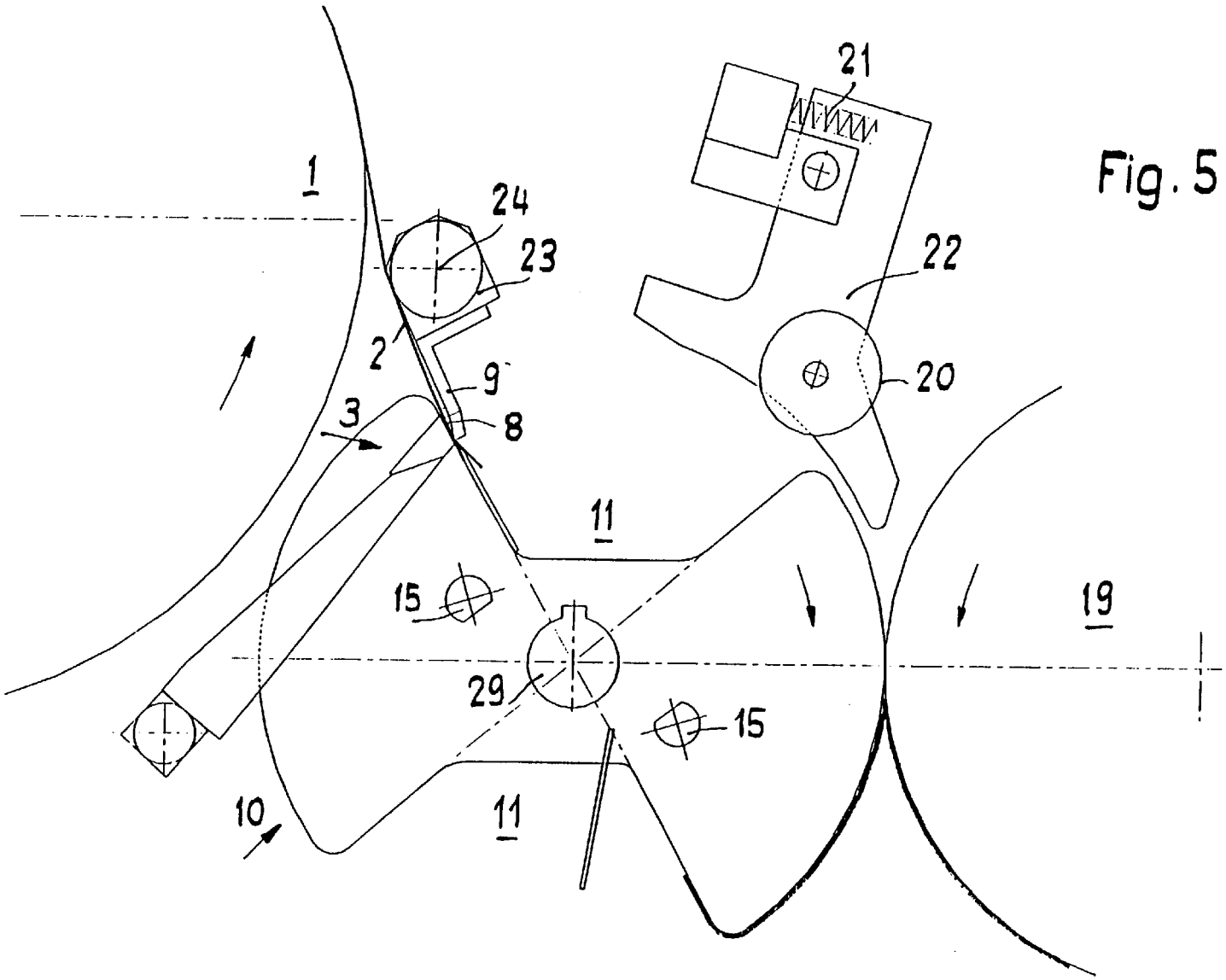
FIG. 5 is a lateral view of the device in a processing phase which is advanced in respect to FIGS. 3 and 4.

FIGS. 3 to 5 represent pre-fold processing of signatures 2, for which a gripper element 18 is provided, which is controlled from the outside via control cam 15 and cooperates with support 12. In a first phase (FIG. 3) gripper element 18, which is opened or placed ahead in respect to support 12, lifts up overfold 16 under the influence of sweeping device 3 and creates an entry opening for itself at the open end of a signature 2.

In a subsequent phase shown in FIG. 4, gripper element 18 has been pivotally displaced against the oppositely turning support 12 and in this way has partially penetrated into signature 2.

In the following phase shown in FIG. 5, support 12 and gripper element 18 form a closed gripper, which holds signature 2 on the side without the overfold and conveys it.

In the course of post-fold as well as pre-folding processing, after being gripped at the open end, a signature 2 is placed with the aid of the rotating movement of gripper device 10 against the circumference of one of the two laterally spaced disks 36, each of which comprises a section of a circle due to cutouts 11. The signature is spread open by the effect of an oppositely turning, drum-shaped opening device 19, released from the grippers and ejected onto a gathering section which is not shown.

On the downstream-directed way to the opening operation, signature 2 runs underneath a smoothing roller 20 which smooths signature 2 on the circumference of disks 36 of gripper device 10, so that it takes up a constant even, position which aids conveyance, particularly if grippers 13, 14, 18 are released from signature 2. Smoothing roller 20 can be placed against the circumference of the gripper device 10 by means of its own mass attraction or with the aid of a spring 21, wherein this contact can be achieved by a pivot movement of a support 22 receiving the smoothing roller 20.

Furthermore, the free end of the leg constituting the guide bar 9 can be bent against the trajectory of the printed sheet 2 in order to provide improved opening conditions.

A freely rotatable support roller 23 disposed opposite conveyor drum 1 limits the trajectory of a signature and constitutes a support of the deflection movement. The axis of rotation 24 of support roller 23 can coincide with the axis of the pivot shaft of guide element 5.

Figure 6:
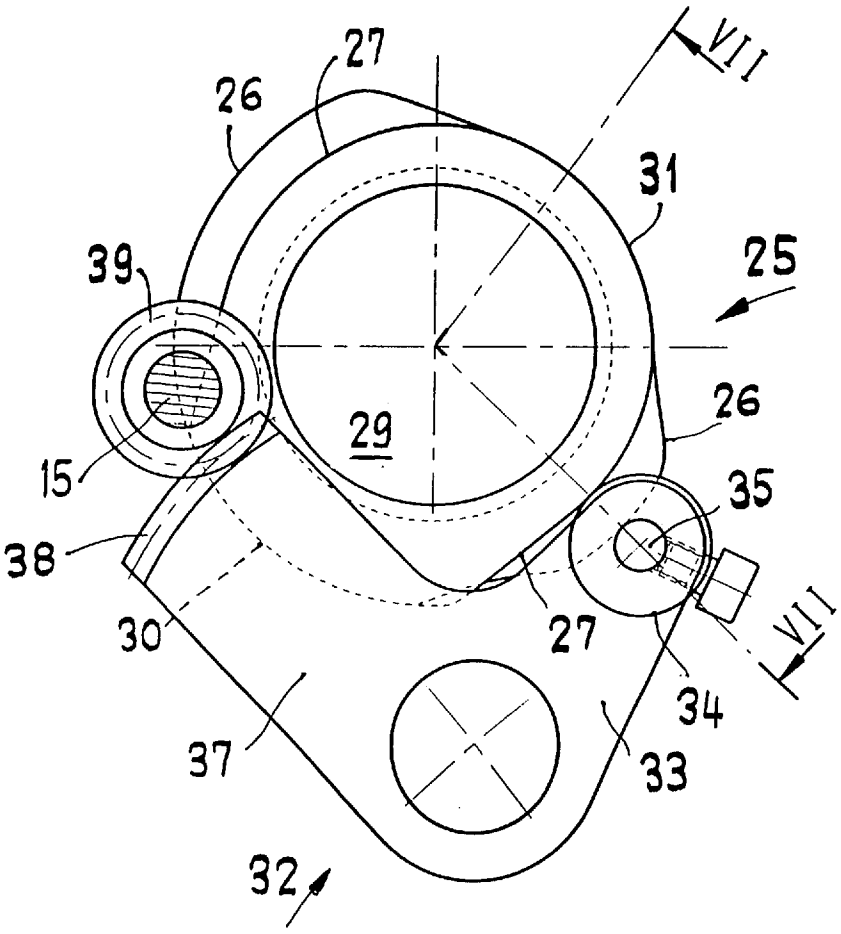
FIG. 6 is a lateral view of a control device within a feeding device for the selective post-fold or pre-fold control of the grippers.
Figure 7:
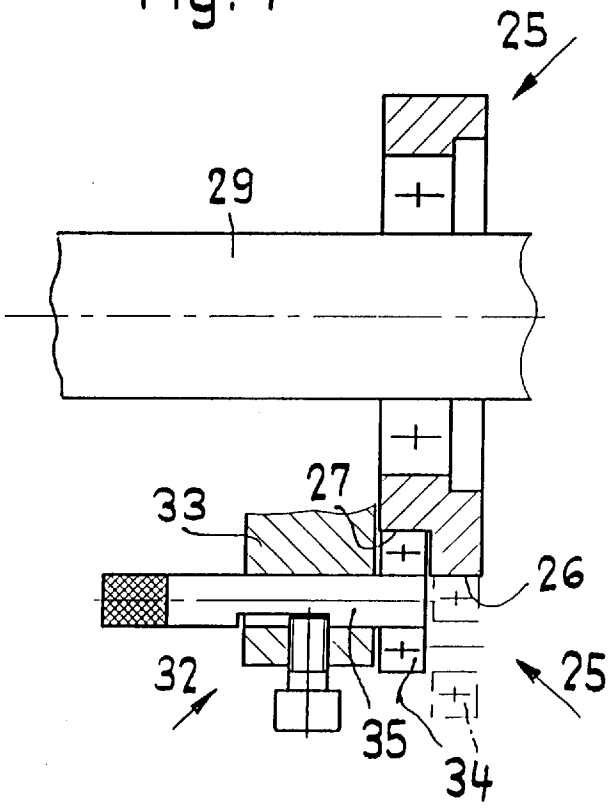
FIG. 7 is a section through the control device along the line VII—VII in FIG. 6.

FIGS. 6 and 7 illustrate a control device 25 associated with the post-fold or pre-fold processing, which can be selectively connected with the respective grippers or gripper elements 13, 14, 18, 12 of gripper device 10. Control device 25 is constituted by two adjoining endless control cams 26, 27 and is fastened on the machine frame of the support by means of screws (not visible) passing through bores 28. Control device 25 is also used for seating drive shaft 29 of gripper device 10. Control cam 26 is associated with pre-fold processing, and control cam 27 is associated with post-fold processing. Both control cams 26, 27 have two common control sections 30, 31, at which a change of the type of processing, pre-folding or post-folding, can be performed. A control lever 32 rotating with drive shaft 29 has a feeler roll 34 on a first lever arm 33, which is equipped with an axially displaceable bearing shaft 35 for changing control cam 26, 27 on common control sections 30, 31. A toothed segment 38 is provided on an angled second lever arm 37 of control lever 32, which meshes with a gear wheel 39 fastened on pivotable control shaft 15 of the grippers.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. In a device for feeding a gathering section of a gather-stitcher including: a rotatingly driven conveyor drum which pulls signatures off a stack of a signature magazine with the fold in front and having a circumference to which means are assigned for conveying the signatures in an approximately circular path in which there is disposed an arresting device and then into a trajectory extending in an opposite direction from the arresting device which trajectory terminates in a functional area of a rotating gripper device of an opening mechanism which opens the signatures, the improvement comprising:

a sweeping device comprising a deflecting bar arranged for moving into the trajectory of the signatures; and an adjustable guide bar located opposite the sweeping device during its movement, the sweeping device sweeping the respective signatures on the oppositely located guide element and into a gripping position associated with the gripper device, the deflecting bar being pivotable parallel with the axis of rotation of the conveyor drum from a position behind the circumference of the conveyor drum to a position which defines, together with the adjustable guide bar, a guide gap for receiving the printed sheets;

wherein said feeding device is utilized for supplying signatures with a post-fold to the gripper device, the gripper device is drum-shaped with a sector-shaped cutout and includes at least one pair of sheet grippers disposed in the sector-shaped cutout, and the adjustable guide bar has an end facing the gripper device which includes a cutout for the passage of one of the sheet grippers which holds the signatures on the gripper device.

2. A device in accordance with claim 1, wherein the deflecting bar and the guide bar are disposed to lie opposite each other to define the guide gap in a gripping position of the gripper device.

3. In a device for feeding a gathering section of a gather-stitcher including: a rotatingly driven conveyor drum which pulls signatures off a stack of a signature magazine with the fold in front and having a circumference to which means are assigned for conveying the signatures in an approximately circular oath in which there is disposed an arresting device and then into a trajectory extending in an opposite direction from the arresting device which trajectory terminates in a functional area of a rotating gripper device of an opening mechanism which opens the signatures, the improvement comprising:

a sweeping device comprising a deflecting bar arranged for moving into the trajectory of the signatures; and an adjustable guide bar located opposite the sweeping device during its movement, the sweeping device sweeping the respective signatures on the oppositely located guide element and into a gripping position associated with the gripper device, the deflecting bar being pivotable parallel with the axis of rotation of the conveyor drum from a position behind the circumference of the conveyor drum to a position which defines, together with the adjustable guide bar, a guide gap for receiving the printed sheets;

wherein said feeding device is utilized for supplying signatures with a pre-fold to the gripper device, the pre-fold signature having one signature part presenting an overhang and another signature part overlapped by the one signature part, and the gripper device is drum-shaped with a sector-shaped cutout defining a support and includes a driven gripper element disposed in the sector-shaped cutout which is adapted to lift and hold the one signature part provided with the over-fold and subsequently hold the other signature part resting against the support.

4. A device in accordance with claim 3, wherein the gripper element is controllably pivotable.

5. In a device for feeding a gathering section of a gather-stitcher including: a rotatingly driven conveyor drum which pulls signatures off a stack of a signature magazine with the fold in front and having a circumference to which means are assigned for conveying the signatures in an approximately circular path in which there is disposed an arresting device and then into a trajectory extending in an opposite direction from the arresting device which trajectory terminates in a functional area of a rotating gripper device of an opening mechanism which opens the signatures, the improvement comprising:

a sweeping device comprising a deflection element arranged for moving into the trajectory of the signatures; and a guide element located opposite the sweeping device during its movement, the sweeping device sweeping the respective signatures on the oppositely located guide element and into a gripping position associated with the gripper device;

wherein the gripper device includes a rotating drum and further comprising a smoothing roller disposed downstream of the sweeping device for smoothing the signatures against the circumference of the rotating drum.

6. A device in accordance with claim 5, further including a spring disposed for presenting a force against which the smoothing roller is lifted off the gripper device.

7. In a device for feeding a gathering section of a gather-stitcher including: a rotatingly driven conveyor drum which pulls signatures off a stack of a signature magazine with the fold in front and having a circumference to which means are assigned for conveying the signatures in an approximately circular oath in which there is disposed an arresting device and then into a trajectory extending in an opposite direction from the arresting device which trajectory terminates in a functional area of a rotating gripper device of an opening mechanism which opens the signatures, the improvement comprising:

a sweeping device comprising a deflection element arranged for moving into the trajectory of the signatures; a guide element located opposite the sweeping device during its movement, the sweeping device sweeping the respective signatures on the oppositely located guide element and into a gripping position associated with the gripper device; and a rotatable support roller disposed opposite the conveyor drum upstream of the sweeping device with respect to the trajectory of the signatures from the arresting device for limiting the trajectory of the signatures.

8. A device in accordance with claim 7, wherein the support roller and the guide bar have a common axis of rotation.

9. In a device for feeding a gathering section of a gather-stitcher including: a rotatingly driven conveyor drum which pulls signatures off a stack of a signature magazine with the fold in front and having a circumference to which means are assigned for conveying the signatures in an approximately circular path in which there is disposed an arresting device and then into a trajectory extending in an opposite direction from the arresting device which trajectory terminates in a functional area of a rotating gripper device of an opening an opening mechanism which opens the signatures, the improvement comprising:

a sweeping device comprising a deflection element arranged for moving into the trajectory of the signatures; a guide element located opposite the sweeping device during its movement, the sweeping device sweeping the respective signatures on the oppositely located guide element and into a gripping position associated with the gripper device; and a rotatable support roller disposed opposite the conveyor drum upstream of the sweeping device with respect to the trajectory of the signatures from the arresting device for limiting the trajectory of the signatures.

10. A device in accordance with claim 9, wherein the control device includes: two control cams stationarily disposed next to each other around an axis of rotation of the gripper device; a control lever drivably connected for turning around the axis of rotation of the gripper device; and an axially displaceable feeler roll seated on the control lever for selective engagement of a respective one of the control cams.

11. A device in accordance with claim 10, wherein the deflecting bar and the guide bar are disposed to lie opposite each other to define the guide gap in a gripping position of the gripper device.

* * * * *